United States Patent [19]

Butz

[11] 4,022,345

[45] May 10, 1977

[54] DRUM WITH HANDLING RINGS

[75] Inventor: Klaus Siegfried Butz, Anaheim, Calif.

[73] Assignee: Advanced Chemical Technology, City of Industry, Calif.

[22] Filed: Mar. 15, 1976

[21] Appl. No.: 666,595

[52] U.S. Cl. ..... 220/71; 220/85 K; 220/73

[51] Int. Cl.[2] ..... B65D 7/42; B65D 25/00

[58] Field of Search ..... 220/71, 73, 85 R, 85 K, 220/3, 5 R

[56] References Cited

UNITED STATES PATENTS

| | | | |
|---|---|---|---|
| 2,127,263 | 8/1938 | Lambert | 220/71 X |
| 3,166,777 | 1/1965 | Frantz | 220/85 K |
| 3,387,741 | 6/1968 | Kulaszewski | 220/73 |

*Primary Examiner*—William Price
*Assistant Examiner*—Steven M. Pollard
*Attorney, Agent, or Firm*—Kleinberg, Morganstern, Scholnick & Mann

[57] ABSTRACT

A plastic drum having a cylindrical mid-section and tapered shoulders terminating in generally planar end walls is adapted to receive and retain at its upper and lower shoulders, ring-shaped attachments encircling the circumference of the drum to facilitate handling and stacking.

5 Claims, 4 Drawing Figures

DRUM WITH HANDLING RINGS

BACKGROUND OF THE INVENTION

1. Field of the Invention

The present invention relates generally to containers, specifically to plastic drums of the stackable type.

2. Description of the Prior Art

To achieve structural strength with a miniumum of weight, one form of conventional plastic container or drum includes a cylindrical central portion merging on either side thereof into upper and lower sections which are tapered inwardly relative to the longitudinal axis of the drum. These upper and lower sections terminate in generally planar end walls. The resulting plastic drum therefore has a keg-like shape, in contrast to the generally cylindrical shape of conventional steel drums.

Because of their shape, conventional cylindrical steel drums can be easily rolled, stacked and manipulated in stable geometric arrangements. In contrast, the plastic drums with curved upper and lower portions are difficult to handle and stack.

In U.S. Pat. No. 3,889,839, issued to Butz and Simon and entitled, "Blow Molded Drum", and assigned to asignee of the present application, there is shown a drum configuration having flat, recessed indentations on its upper and lower sidewall surfaces near the shoulder thereof, to facilitate handling of the drum by a fork lift. While this improvement results in easier handling, it does not result in a plastic drum having the same rolling stacking and handling characteristics as a conventional cylindrical steel drum.

The German firm of Mauser is currently manufacturing a plastic drum having a plastic handling ring at each end which extends beyond the outermost diameter of the body of the drum and which extends beyond the planar end walls of the drum. It is understood that these rings are formed by putting a separate piece of plastic in the mold when the drum is formed, and the rings therefore are permanently welded to the plastic of the drum.

This technique not only slows production of the drums, but prevents replacement of the rings when they become damaged. These rings have the further disadvantage in that any spillage that accumulates on the top outer surface of the drum during filling is retained there by the ring.

When the drum is rolled, only the rings make contact with the ground and the center portion of the drum is substantially unsupported. Because the rings extend beyond the ends of the drum, the drums cannot be safely stacked without the use of pallets.

Thus, it is seen that there is a need for a plastic, keg-like drum to which optional handling rings can be removably attached and which, when in place, enable the plastic drum to be handled, rolled and stacked as easily and with the same means as conventional, cylindrical steel drums.

SUMMARY OF THE INVENTION

The present invention includes a keg-shaped plastic drum having a special shape near its upper and lower shoulders to permit attachment of an optional, removable handling ring. The use of the handling ring permits drums so equipped to be stacked without pallets, or on their sides, or in pyramid arrangement. The rings enable the drum to be handled, lifted and manipulated by the full range of material handling equipment including fork lifts, hand trucks, "clam shells" "parrot beakers", etc.

The use of the rings adds strength to the drums and protects the bung. Since the rings are subjected to much wear and tear, they are made removable to facilitate reconditioning of the drum. When the drum is rolled on a flat surface, both rings, as well as the center portion of the drum, are in contact with the flat surface. Thus, the rings do not have to bear the full weight of the drum, and deformation of the drum is minimized.

In a preferred embodiment, the rings are made of a plastic material. In an alternative embodiment, the rings may be formed of metal or any other suitable material. After the rings have been formed as separate parts, they are pressed over the ends of the drum, snapping into their desired position. The rings are then retained by their shape and the shape of the drum.

In the preferred embodiment, the top and bottom rings are identical in cross-section and diameter. The bottom ring is unbroken on its innermost diameter while the top ring features two cutouts to provide access to the drum openings.

When in position, the uppermost surface of the top ring and the lowermost surface of the bottom ring are flush with the planar end walls of the drum and the outside diameter of the rings match the largest outside diameter of the drum. The rings are held in place by their unique shape and the unique shape of the drum. The drum has indentations into which the inward facing parts of the ring fit and lock.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
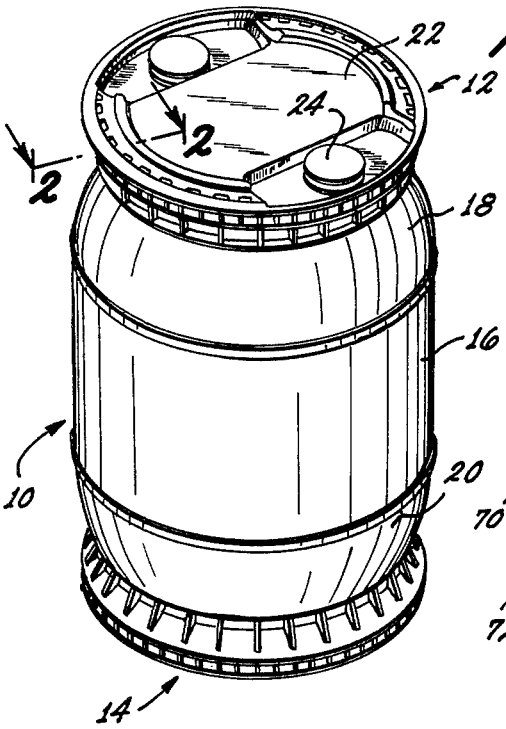
FIG. 1 is a perspective view of a drum equipped with the handling rings according to the present invention.

Turning first to FIG. 1, a plastic drum 10 of the present invention to which handling rings 12, 14 of the present invention have been attached. The drum 10 includes a substantially cylindrical central section 16 merging respectively into an upper section 18 and lower section 20. Upper section 18 is terminated by a substantially planar end wall 22, including a bung 24. Lower section 20 is also terminated by a planar end portion (not seen).

From FIG. 1, it can be seen that the rings 12, 14 are coplanar with the ends 22 of the drum and that the diameter of the rings 12, 14 is the same as the largest diameter of the drum. It can also be seen that the ring 12 protects the bung 24.

Figure 2:
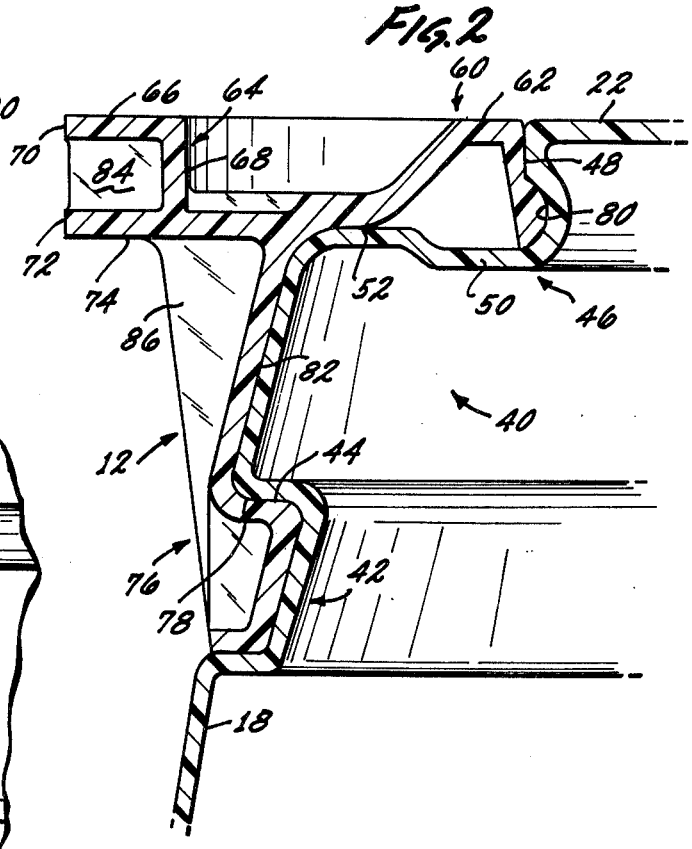
FIG. 2 is a partial cross-sectional view across a section of the drum wall and ring according to a preferred embodiment of the present invention taken along the line 2—2 of FIG. 1 in the direction of the appended arrows.

As shown in FIG. 2, the ring 12 is fitted to the drum 10 in the shoulder portion 40 of the drum, and is held in place by the unique shape of the ring 12 and drum 10, which will be described below.

In the shoulder region 40, the planar end section 22 of the drum merges into the upper wall section 18 of the side of the drum 10. The upper wall section 18 is provided with a circumferentially extending recessed portion 42 defining an overhanging brow 44.

Likewise, a second recess 46 is formed between planar end section 22 of the drum and the shoulder portion 40. Recess 46 defines a surface 48 extending radially inwardly and downwardly so as to undercut the peripheral portion of end section 22. Recess 46 further includes a portion defining a recessed surface 50 which lies below surface 52.

The ring 12 includes a hub portion 60 whose uppermost surface 62 is intended to be flush with the uppermost surface of end portion 22 of the drum 10. The shape of the hub portion 60 generally conforms to that of recess 46 where those parts are adjacent.

Ring 12 further includes a rim portion 64 whose uppermost surface 66 is also coplanar with the uppermost surface of end portion 22 of the drum. The outer diameter of the rim portion 64 is defined by cylindrical surfaces 70, 72 and is equal to the largest diameter of the drum 10. Rim portion 64 further defines a cylindrical axially extending surface 68 which together with overhanging brow 74 facilitates handling of the drum with a drum gripper (parrot beaker) or to retain and manipulate a drum on a handcart. The underside of rim portion 64 defines a planar, annular surface 74, which also facilitates lifting to the drum 10 by a fork lift or similar apparatus.

The ring 12 further includes a clamping portion 76 whose inward facing surfaces generally conform to those of upper shoulder section 40 and recessed portion 42 of drum 10. Clamping portion 76 further includes an inner retaining surface 78.

The operation of the ring 12 will now be described in connection with FIG. 2. When the drum 10 is rolled on its side, surfaces 70 and 72 are in contact with the surface over which the drum is being rolled, because their diameter is the same as the largest diameter of drum 10. If the diameter of the rim portion were greater than the diameter of the drum, the drum would in effect be supported only by the rings 12, 14 when being rolled and hence would tend to deform.

On the other hand, if the diameter of rings 12, 14 were less than the largest diameter of the drum, the rings would provide no support to the ends of the drum. When, as in the preferred embodiment of FIG. 2, the diameter of the rings 12, 14 equals the largest diameter of the drum 10, the weight of the drum will be supported both at the ends as well as along the center section 16 of the drum 10.

Because surfaces 62 and 66 of ring 12 are coplanar with the uppermost surface of end portion 22 of the drum, the rings in no way interfere with stacking of the drums. On the contrary, stacking is facilitated because the ring functions as an extension of the planar end of the drum 10 and the drums can be stacked on their ends on top of one another without the necessity of using pallets, or the durms can be stacked overlapping one another forming a pyramid.

The same holds true for the bottom ring 14.

When a drum 10 is picked up by a fork lift, surface 74 bears against the forks and the weight of the drum 10 is borne by surfaces 78 and 80 of the ring 12. Because of its cylindrical structure, clamping portion 76 strongly resists outward forces, thereby preventing its slipping out of recess 42. Further, hub section 60 of the ring 12, because of its circular structure also strongly resists radially outward forces, thereby assuring that surface 48 and 46 of the drum will be retained within the innermost diameter of hub section 60 of the ring 12.

When the drum 10 is being conveyed on a hand cart, it is well-known in the art to grasp the top of the drum with the upper hook of the handcart which resembles an inverted "J". The shorter leg thereof fits inside rim section 64 against surface 68 to prevent drum 10 from falling forward off the hand truck.

In use, the upper hook exerts a radially outward force against surface 68 of rim portion 64. This force tends to pull hub section 60 laterally with respect to recess 46. That portion of hub 60 on the same side of the center line of the drum as the hook tends to pull slightly away from surface 48, but the portion of hub 60 on the opposite side of the center line is drawn into an even tighter locking arrangement with the drum. Thus, lateral forces do not dislodge the ring.

Similarily, the same forces are exerted if a drum is being manipulated with a drum gripper known in the art as a "parrot beaker".

The resistance of the ring to removal as described in the above paragraphs does not preclude its being attached to the drum initially. The ring and the drum are separate parts held together in an interlocking engagement.

The ring is affixed to the drum by positioning it on top of the drum and applying a large downward force to the ring, forcing the lower part of clamping portion 76 to expand sufficiently to clear shoulder surface 82. Because of the slight radially outward taper of surface 82, a large mechanical advantage is available providing a wedge-like, spreading action to expand the lower part of clamping portion 76.

Thus, the ring snaps into its desired position when the ring has been pushed downward on the drum sufficiently to permit surface 78 of the ring to clear surface 44 of the drum. At the same time, surface 80 of the hub portion 60 is locked into place by surface 48 of the drum. Thus, once the ring has been snapped into place, under great pressure, it remains permanently affixed to the drum. Similarily the lower ring is attached to the bottom of the drum in the same fashion.

Figure 3:
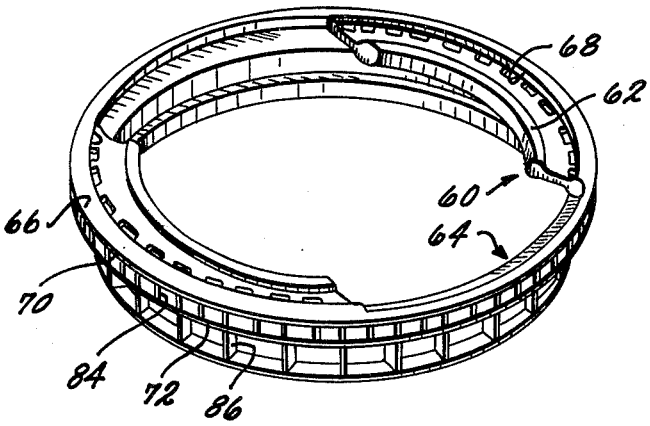
FIG. 3 is a perspective view of the preferred embodiment of a handling ring according to the present invention; and, FIG. 4 is a partial cross-sectional view of a ring, formed of metal according to an alternative embodiment of the present invention.

In a preferred embodiment, the ring is molded of a plastic material. In the interest of saving material, it has been found that the ring can also be constructed from a basic skeleton, reinforced by webs 84, 86 as shown in FIG. 2, and better illustrated in FIG. 3, wherein like numbers refer to like parts, or solid from an expandable or foamable plastic material.

Figure 4:
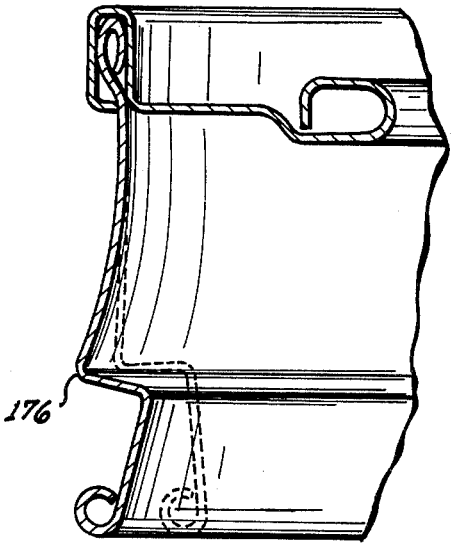

In an alternative configuration, the ring may be formed of sheet metal, formed as shown in FIG. 4. The clamping portion 176 is manufactured to have the shape shown by the dotted line in FIG. 4, and is elastically deflected to the position shown by the solid lines after assembly. The sheet metal ring functions in a manner similar to the plastic ring described above.

Thus, there has been described a drum and handling rings for use with the drum. The drum has a specialized shape in its shoulder areas which permits the separately formed rings to be snapped into place on the drum where they are locked against removal by the forces encountered in ordinary usage. The ring permits the drums to be stacked in an upright position without the use of pallets, and provides additional support to the drums when they are stacked on their sides. Additional support is also provided by the rings when the drum is rolled on its side. The ring has a flanged portion which greatly facilitates lifting and manipulating the drum.

When affixed to the drum, the ring provides additional protection against damage to the bung and protects the more expensive drum from the considerable wear and tear encountered in handling. The ring can be retrofitted to existing drums and can be removed from the drum if damaged.

The foregoing detailed description is illustrative of a preferred and alternative embodiment of the invention, and it is to be understood that yet additional embodiments thereof will be obvious to those skilled in the art. The embodiments described herein together with those additional embodiments are considered to be within the scope of the invention.

What is claimed is:

1. A handling ring for attachment to a drum having a first recessed wall portion adjacent an end of the drum, merging with it and recessed radially inwardly away from the end forming an undercut circumferentially-extending step between the shoulder of the drum and the end of the drum, and having a second groovelike recessed wall portion extending circumferentially on the side of the drum adjacent its shoulder and having a brow portion overhanging the second recessed portion, said handling ring comprising:

a hub portion disposed on a circle of diameter substantially equal to the diameter of said first recessed wall portion;

a circular rim portion integral with said hub portion, having a diameter equal to the largest diameter of the drum and coextensive with the end of the drum; and, a clamping portion including a surface adapted to substantially conform to the second recessed portion and the brow portion;

whereby said hub portion fits into the undercut first recessed wall portion and said clamping portion fits into the groove-like second recessed wall portion to hold the ring in place on the drum.

2. The handling ring of claim 1 for use with a drum having substantially planar ends, wherein said circular rim portion further comprises a surface coplanar with the end of the drum.

3. A drum adapted for use with an optionally affixable handling ring having a hub portion disposed on a circle of predetermined diameter and having a clamping portion including a circumferentially and radially, inwardly extending flange, said drum comprising:

a first recessed wall portion adjacent an end of the drum, merging with it and recessed radially, inwardly away from the end forming an undercut circumferentially-extending step between the shoulder of the drum and the end of the drum, the shape of said first recessed wall portion substantially conforming to that of the hub portion of the handling ring, said first recessed wall portion having a diameter smaller than the diameter of the end of the drum; and, a groove-like second recessed wall portion extending circumferentially on the side of the drum adjacent the shoulder of the drum and having a brow portion overhanging said second recessed wall portion, said second recessed wall portion conforming in shape to the radially, inwardly extending flange of the handling ring;

whereby the hub of the handling ring extends into the first recessed wall portion and the flange of the handling ring fits into the second recessed wall portion of the drum to hold the handling ring in place on the drum.

4. A drum and a handling ring for attachment to the drum, the combination comprising:

a drum having a first recessed wall portion adjacent an end of the drum, merging with it and recessed radially, inwardly away from the end forming an undercut circumferentially-extending step between the shoulder of said drum and the end of said drum, said first recessed wall portion having a diameter smaller than the diameter of the end of said drum, said drum further having a groove-like second recess wall portion extending circumferentially on the side of the drum adjacent its shoulder and having a brow portion overhanging said second recessed portion;

a handling ring having a hub portion disposed on a circle of diameter substantially equal to the diameter of said first recessed wall portion, having a circular rim portion integral with the hub portion, said circular rim portion having a diameter equal to the largest diameter of said drum and coextensive with the end of said drum, said handling ring further having a clamping portion including a surface adapted to substantially conform to the second recessed wall portion of said drum and to the brow portion of said drum;

whereby the hub portion of said handling ring fits into the undercut first recessed wall portion and the clamping portion of said handling ring fits into the groovelike second recessed wall portion of said drum to hold the ring in place on the drum.

5. The combination of Claim 4, wherein said drum further comprises a substantially planar end and wherein said handling ring further comprises a surface coplanar with the end of said drum.

* * * * *